United States Patent [19]

Jean-Jacques

[11] Patent Number: 4,675,921

[45] Date of Patent: Jun. 30, 1987

[54] DEVICE FOR USE WITH AUTOMATIC POOL CLEANER

[76] Inventor: Leonard Jean-Jacques, P.O. Box 552, Rivonia, Transvaal, South Africa, 2128

[21] Appl. No.: 839,989

[22] Filed: Mar. 17, 1986

[30] Foreign Application Priority Data

| | | | |
|---|---|---|---|
| Mar. 18, 1985 | [ZA] | South Africa | 85/1989 |
| May 10, 1985 | [ZA] | South Africa | 85/3546 |
| Feb. 11, 1986 | [ZA] | South Africa | 86/0981 |

[51] Int. Cl.[4] ..... B08B 9/08

[52] U.S. Cl. ..... 4/490; 15/1.7; 134/167 R

[58] Field of Search ..... 134/167 R; 441/1, 4–6, 441/23, 133; 210/169; 4/496; 15/1.7

[56] References Cited

U.S. PATENT DOCUMENTS

| | | | |
|---|---|---|---|
| 3,108,298 | 10/1963 | Gelinas | 15/1.7 |
| 3,217,886 | 11/1965 | Ruston | 15/1.7 |
| 3,229,315 | 1/1966 | Watson | 15/1.7 |
| 3,265,079 | 8/1966 | Blumenfeld | 15/1.7 |
| 3,295,540 | 1/1967 | Ortega | 15/1.7 |
| 3,590,635 | 7/1971 | Duing | 441/23 |
| 3,926,667 | 12/1975 | Gibellina | 134/167 R |
| 4,017,331 | 4/1977 | Thoeler, Sr. | 134/167 R |
| 4,040,864 | 8/1977 | Steeves | 134/167 R |
| 4,065,822 | 1/1978 | Wilbourn | 441/4 |
| 4,193,156 | 3/1980 | Chauvier | 15/1.7 |
| 4,281,995 | 8/1981 | Pansini | 134/167 R |

*Primary Examiner*—Stephen Marcus
*Assistant Examiner*—Leo Peters
*Attorney, Agent, or Firm*—Cushman, Darby & Cushman

[57] ABSTRACT

A device for use with an automatic pool cleaner in a swimming pool which consists of a suction head and a suction pipe connecting the suction head to the filter of the swimming pool. The device comprises an attachment member adapted to be attached to the suction pipe of the pool cleaner, a buoyant member and means for connecting the bouyant member to the attachment member.

12 Claims, 14 Drawing Figures

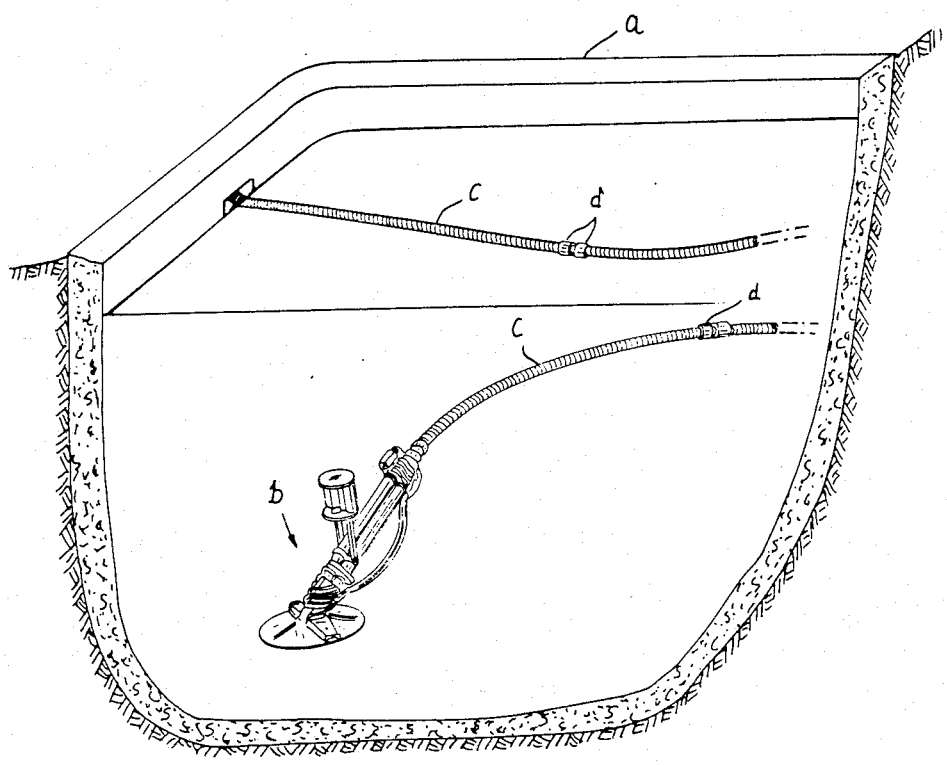
FIGURE A
PRIOR ART

DEVICE FOR USE WITH AUTOMATIC POOL CLEANER

FIELD OF THE INVENTION

This invention relates to a device for use with an automatic pool cleaner.

BACKGROUND TO THE INVENTION

A conventional automatic cleaner for a swimming pool consists of a suction head and a suction pipe connecting the head to the filter of the swimming pool. In use, water is drawn through the head along the suction pipe, conveying dirt and sediment with it. A device in the head creates periodic reaction forces therein when water is drawn through the head, which causes the head to advance of its own accord along the submerged surface of the swimming pool.

It is a well known shortcoming of a conventional pool cleaner that it does not always consistently sweep the entire submerged area of the pool. A pool cleaner might be found, for example, to miss certain areas of the pool or it may tend to lodge itself at certain points in the pool.

Because of this shortcoming, it takes longer for the head to traverse the entire submerged surface of a pool than it should. This means that the cleaner must be kept operating for longer periods in order to keep the pool clean, which increases the maintenance costs of the pool.

It is an object of the invention to provide a device with which the abovementioned disadvantages are sought to be diminished.

SUMMARY OF THE INVENTION

According to the invention a device for use with an automatic pool cleaner in a swimming pool which consists of a suction head and a suction pipe connecting the suction head to the filter of the swimming pool, comprises an attachment member adapted to be attached to the suction pipe of the pool cleaner, a buoyant member and means for connecting the buoyant member to the attachment member.

The attachment member is preferably a carrier ring adapted to embrace, in a loose fitting manner, a pipe universal joint provided in the suction pipe. The carrier ring may be prevented from slipping off the universal joint by annular collars provided on the universal joint at opposite sides of the carrier ring.

The buoyant member may comprise a floating platform and the means for connecting it to the attachment member may comprise a dependent rigid shaft. The shaft may permit universal movement of the buoyant member relative to the carrier ring.

The device may further include a float associated with the floating platform and carrying a sail responsive in use to wind blowing over the surface of the pool. The float may be toroidal in form, surrounding the floating platform in its operative position and trapped thereon by means of an upright mast projecting from the floating platform and passing through the centre of the float. The sail of the float in one form of the invention may be rigid in nature, projecting in upright manner from the float.

In an alternative form of the invention, the buoyant member may comprise an inflatable member providing buoyancy when inflated. The inflatable member may comprise a base member and an upstanding vane responsive in use to wind blowing over the surface of the pool.

In an alternative form of the invention the buoyant member may be an inflatable ball or the like. In such a case, the attachment means may comprise an elongated flexible member. Alternatively, the attachment means may be provided in a form which permits its effective length to vary as the depth of the suction pipe in the pool varies.

The device according to the invention may further include ballast means to ensure that the suction pipe is kept below the water level in the swimming pool.

BRIEF DESCRIPTION OF THE DRAWINGS

Preferred embodiments of the invention will now be described by way of example, with reference to the accompanying drawings in which FIG. A illustrates a prior art automatic pool cleaner.

In the various embodiments hereinafter described, like numbers are used to denote like parts.

DESCRIPTION OF PREFERRED EMBODIMENTS

In FIG. A, a conventional pool cleaner is shown in a swimming pool a. The pool cleaner comprises a suction head b and a suction pipe c (shown broken) which leads from the suction head to the swimming pool filter (not shown). Conveniently, the suction pipe c is provided in lengths joined together by pipe connectors d which connect by means of a force fit. the pool cleaner operates in the manner hereinabove described.

Figure 1A:
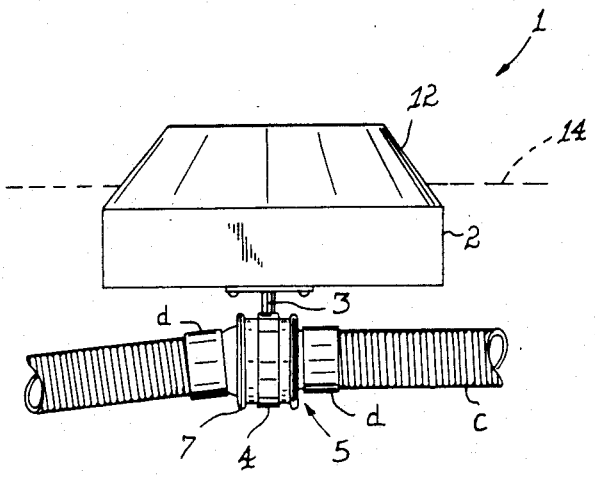
FIGS. 1*a* and 1*b* are an elevation and elevational section respectively of a device according to the invention for use with the pool cleaner of FIG. A.
Figure 1B:
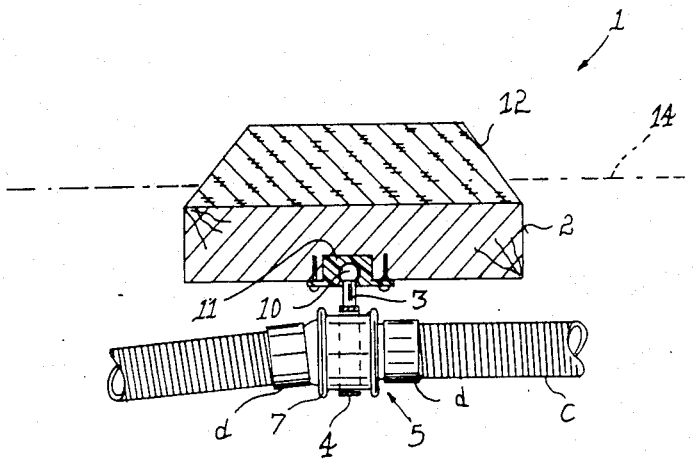

With reference to FIGS. 1*a* and 1*b* a device 1 according to the invention comprises a floating platform 2 connected by a dependent rigid shaft 3 to a carrier ring 4. The carrier ring 4 embraces, in a loose fitting matter, a conventional pipe universal joint 5 provided in the suction pipe c of the automatic pool cleaner. In order to connect the pipe universal joint 5 into the suction pipe c, the pipe is broken at a pipe connector d and the two ends are connected by a force fit to the universal joint. To prevent the carrier ring 4 from slipping off the universal joint 5, collars 7 are provided on the universal joint, on opposite sides of the carrier ring 4. The collars 7 may be of any suitable form and may be applied to the casing of the universal joint in any suitable manner, for example, by being glued or cemented thereto.

The carrier ring 4 is secured to the floating platform 2 in a manner permitting universal movement between the carrier ring and the platform. In this embodiment of the invention this is achieved by means of a head 10 on the shaft 3 being accommodated in a socket in a holder 11 secured to the floating platform, so as to form a ball joint. Other constructions can obviously be used. A crown 12 of a buoyant material, such as foamed polystyrene, is secured to the upper surface of the floating platform to enhance the buoyancy of the floating platform and to keep it floating more or less at the water level 14 when operatively attached to the suction pipe c.

In use, the device 1 is attached to the suction pipe c as described above. If required, two or more such devices are attached along the length of the suction pipe c, each to a pipe universal joint 5. With such an arrangement, the pipe universal joints are kept below the surface of the water in the pool at all times which prevents them from drawing in air.

Figure 2A:
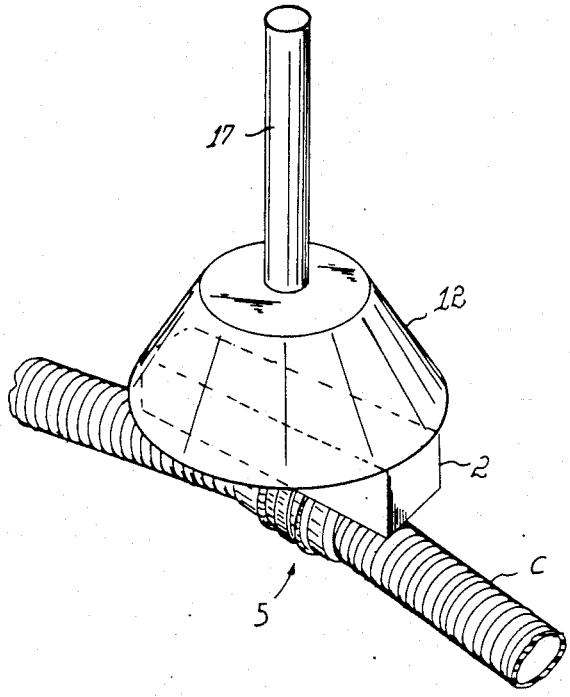
FIGS. 2*a* and 2*b* are perspective views of parts of an alternative form of device according to the invention.
Figure 2B:
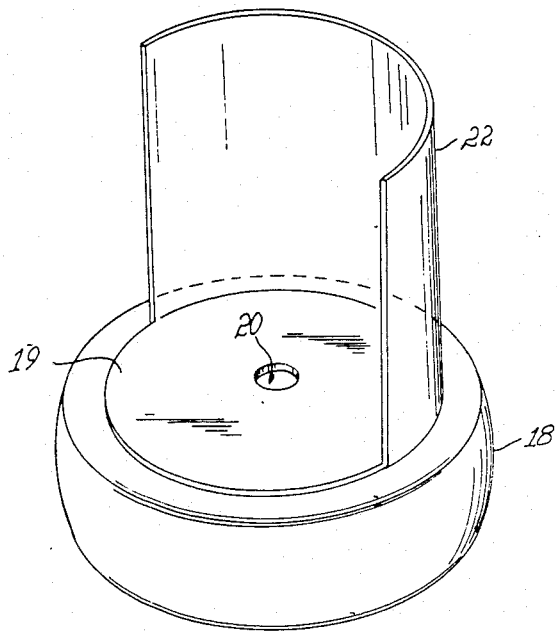

The applicant has found that the above arrangement enhances the flexibility of the suction pipe c and thereby gives the automatic pool cleaner to which it is attached more freedom randomly to move about the submerged area of the pool. When the pool cleaner is functioning, a current will be set up in the pool by the circulation of water through the pool cleaner. This current will tend to act on the device 1 which will thereby tend to interfere with the movement of the pool cleaner. Such interference is beneficial and tends to enhance the random nature of the sweeping action of the cleaning head in the pool. It has also been found that a cleaning head which tends to lodge itself in one position in a pool can be "nudged" by the device 1 to cause it to advance from such position. In the embodiment of the invention shown in FIGS. 2*a* to 2*c*, the device 16 has the same floating platform 2 which is described above, except that it is provided with an upright mast 17 projecting through the crown 12.

Figure 2C:
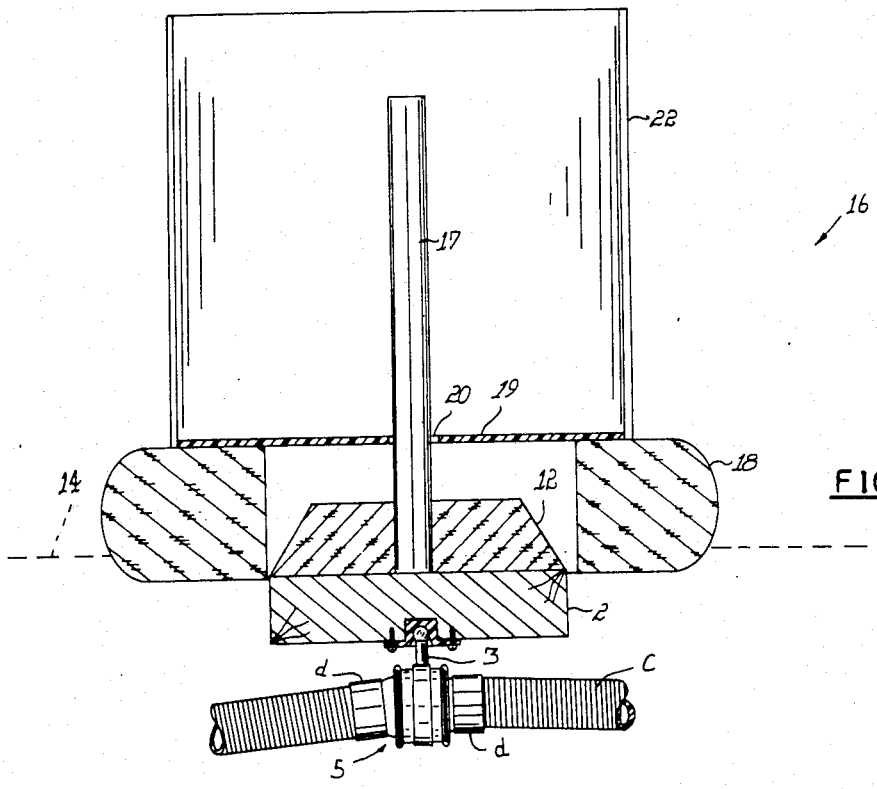
FIG. 2*c* is an elevational section of the device of FIGS. 2*a* and 2*b* in an operative position.

In addition, the device 16 has a float 18 which in this embodiment of the invention is toroidal in form and which in an operative position fits freely around the floating platform 2 (FIG. 2*c*).

The float 18 may be made of the same buoyant material as the crown 8 of the floating platform or it may, for example, be in the form of an inflatable tube. The float 18 in this embodiment of the invention is provided with a deck 19 having a central aperture 20 through which the mast 17 of the floating platform passes. The deck 19 carries an upright rigid sail 22 which in this embodiment of the invention is curved in plan. The deck 19 and sail 22 may, for example, be made of high density polypropylene.

In use, the device 16 is connected to the suction pipe c of the pool cleaner at a position, say, halfway along its length. Alternatively, two or more devices 16 are connected along the length of the suction pipe, each to a pipe universal joint 5.

When the pool cleaner is functioning, the sail 22 of each device 16 will be responsive to wind blowing across the surface of the pool and when the wind blows it will tend to displace the device 16 and hence the suction pipe c which will additionally interfere with the movement of the cleaning head as described above.

The device 16 may of course be driven against the periphery of the pool but because of the loose fit of the float 18 on the floating platform 2, the float can rotate about the platform and thus "roll" along the edge of the pool.

Figure 3A:
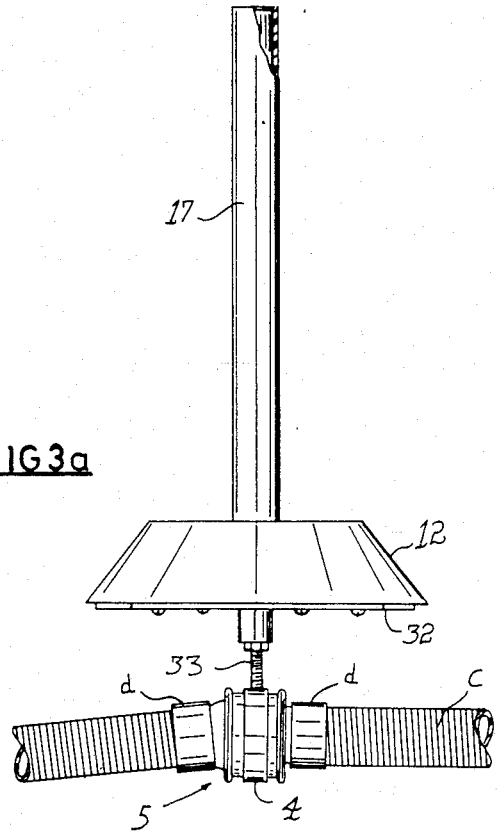
FIG. 3*a* is an elevation of a further alternative form of device according to the invention.
Figure 3B:
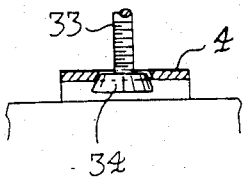
FIG. 3*b* is a section of part of the device of FIG. 3*a;*

FIGS. 3*a* and 3*b* illustrate an alternative form of the floating platform 2 described above. In this form the platform itself is done away with and the crown 12 itself is used as a floating platform which is strengthened by a plate 32 secured to its bottom surface. The plate 32 carries the mast 17 which projects through the crown 12. In this embodiment of the invention the carrier ring 4 is secured to the mast 17 by means of a pin 33 terminating in a head 34 at its lower end, which provides a swivel type joint. The mast 17 in this embodiment of the invention is covered in a plastic sheath to protect it.

Figure 4A:
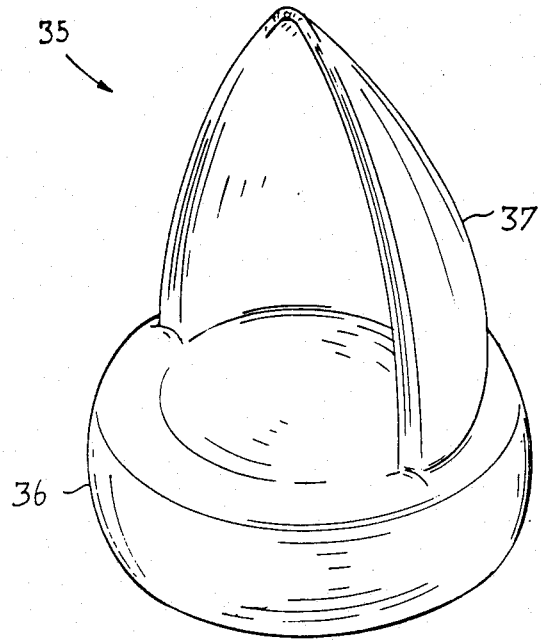
FIGS. 4*a* and 4*b* are a perspective view and an elevational section respectively of a further alternative form of device according to the invention.
Figure 4B:
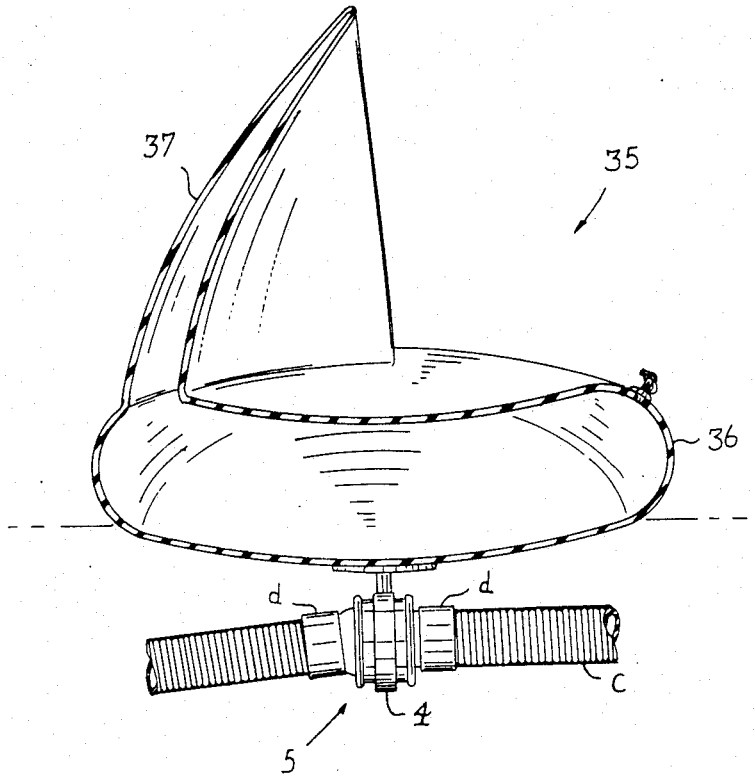

FIGS. 4*a* and 4*b* illustrate a further alternative form of buoyant member of a device according to the invention as shown. In this case the buoyant member is an inflatable member 35 which provides buoyancy once it is inflated. The member 35 comprises a base member 36 from which the carrier ring 4 depends and an upstanding vane 37 which serves the function of the sail 22 described above.

Figure 5:
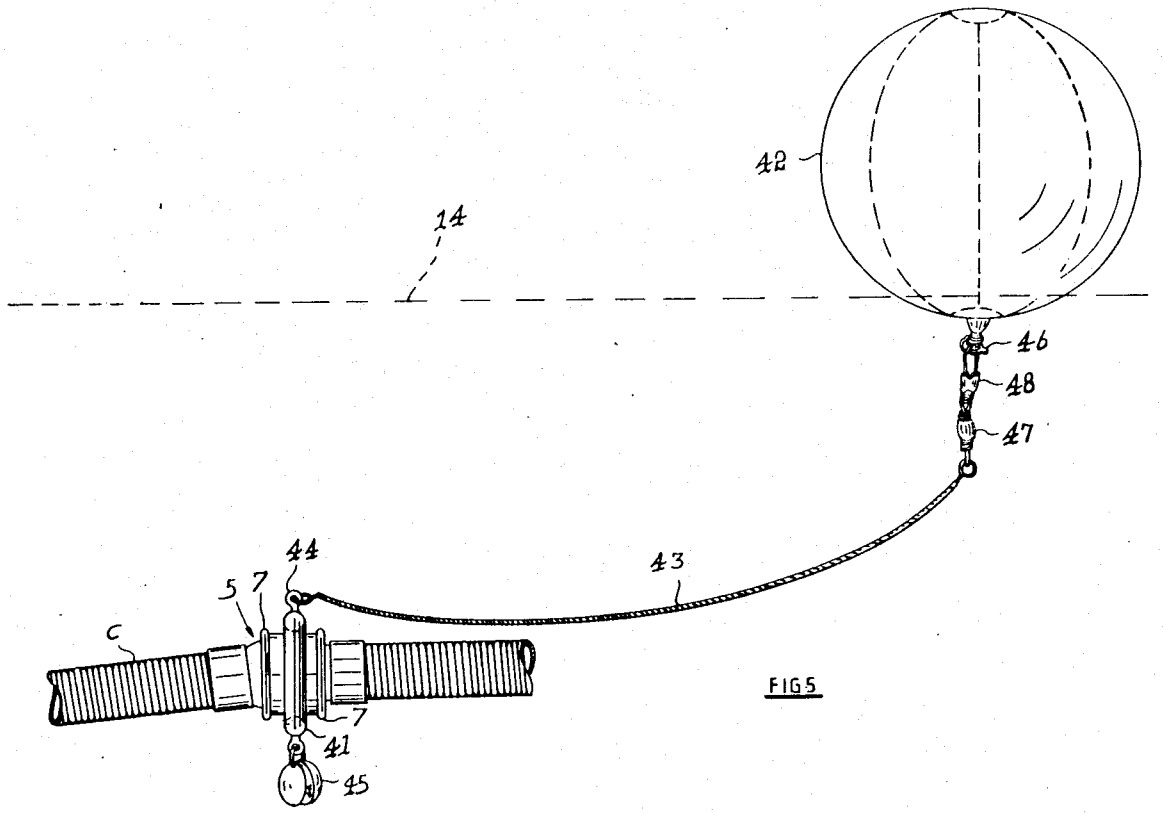
FIGS. 5, 6 and 7*a* are perspective views of further alternative forms of devices according to the invention.

The device shown in FIG. 5 illustrates a further alternative form of the invention. It comprises a carrier ring 41, an inflatable ball 42 and a line 43 which connects the ball to the carrier ring.

As in the embodiments of the invention described above, the carrier ring 41 embraces the suction pipe c in a loose fitting manner. The carrier ring 41 conveniently has an eyelet 44 thereon for purposes of attaching the line 43 thereto. At a position diametrically opposite the eyelet 44, the carrier ring 41 has a similar eyelet carrying a ballast 45 which ensures in use of the device that the suction pipe c is kept below the water level 14.

The line 43 may be of any suitable kind, for instance a helically wound steel line covered in a plastic sleeve.

The inflatable ball 42 may be a conventional plastic beach ball. As shown in FIG. 5, the line 43 conveniently connects to the valve 46 of the ball through a swivel joint 47 and a clip 48.

The applicant has found that the device of FIG. 5 tends to enhance the random nature of the sweeping action of the cleaning head in the pool. Both the wind and currents occurring in the pool will tend to act on the ball 42 which will thereby tend to interfere with the normal movement of the pool cleaner.

Whilst the device described above acts on the suction pipe c it does permit the cleaning head, by virtue of the length of line 43, to descend to the deepest parts of the pool.

Figure 6:
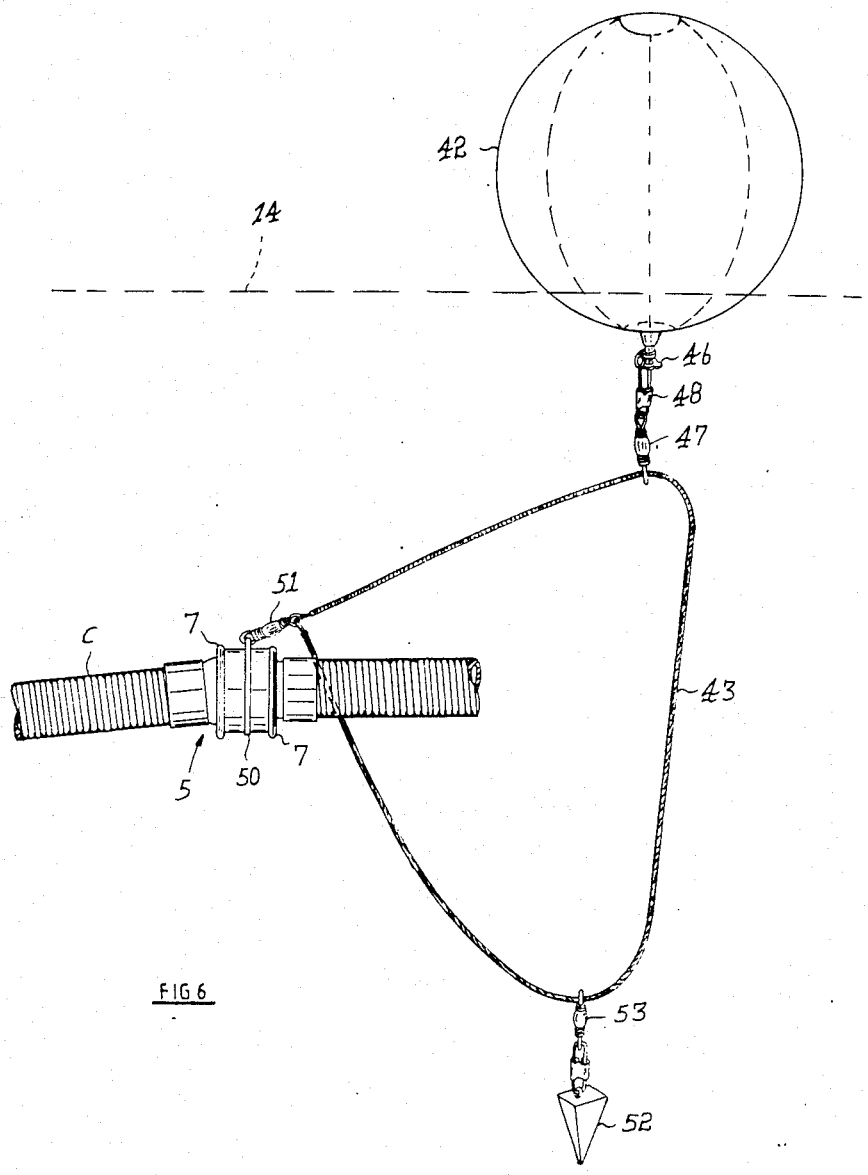

In the embodiment of the invention shown in FIG. 6 the carrier ring 50 surrounding the pipe universal joint 4 is of more slender form to enable it to pass through the eye of a swivel joint 51 to which the line 43 is connected in a loop. A ballast 52 is also connected in the loop through a swivel joint 53.

In use the device of FIG. 6 operates in much the same manner as the device of FIG. 5 to enhance the random movement of the pool cleaner. The arrangement of the line 43 in a loop also permits the suction pipe c to descend into the water in the pool.

Figure 7A:
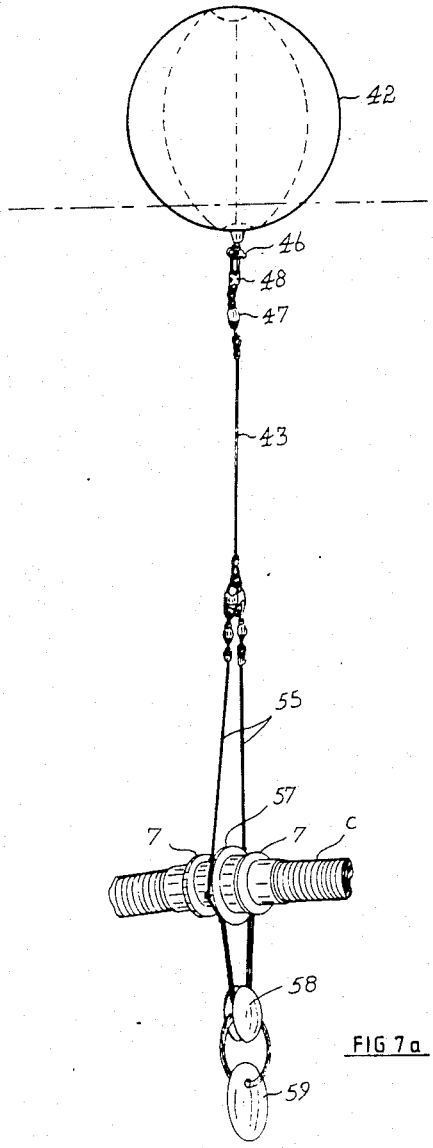
Figure 7B:
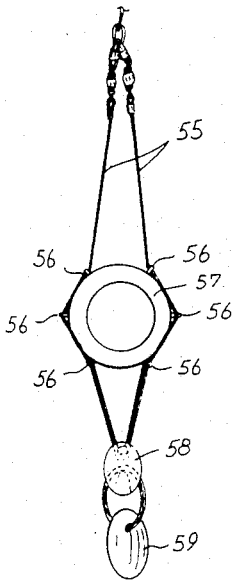
FIG. 7*b* is an elevation of part of the device of FIG. 7*a*.

In the embodiment of the invention shown in FIGS. 7*a* and 7*b*, the line 43 is connected to double lines 55 which permit the effective distance between the ball 42 and the suction pipe c to vary. The double lines 55 pass through eyes 56 on opposite sides of the carrier ring 57 whereafter each passes through an opening in a sliding ballast 58. From there the lines 55 pass to the lowermost eyes 56 where they are secured. This arrangement permits the suction pipe c to descend and ascend in the pool whilst allowing the ball 42 a fair amount of mobility on the surface of the water to respond to wind and currents in the water. The sliding ballast member 58 may have its ballast enhanced by a further ballast 59 connected thereto.

Many other embodiments of the invention may be made differing in matters of detail only from those described above and without departing from the scope of the invention as defined in the appended claims.

I claim:

1. A device for use with an automatic pool cleaner in a swimming pool which consists of a suction head and a suction pipe connecting the suction head to the filter of the swimming pool, comprising an attachment member adapted to be attached to the suction pipe of the pool cleaner, a buoyant member and means for connecting the buoyant member to the attachment member, said buoyant member comprising an inflatable member providing buoyancy when inflated, said inflatable member comprising a base member and an upstanding vane responsive in use to wind blowing over the surface of the pool.

2. A device according to claim 1 in which the attachment member is a carrier ring adapted to embrace, in a loose fitting manner, a pipe universal joint provided in the suction pipe.

3. A device according to claim 2 including annular collars provided on the universal joint at opposite sides of the carrier ring, preventing the carrier ring from slipping off the universal joint.

4. A device according to claim 2 in which the buoyant member comprises a floating platform and the means for connecting it to the attachment member comprises a dependent rigid shaft.

5. A device according to claim 4 in which the shaft permits universal movement of the buoyant member relative to the carrier ring.

6. A device according to claim 4 including a float associated with the floating platform and carrying a sail responsive in use to wind blowing over the surface of the pool.

7. A device according to claim 6 in which the float is toroidal in form, surrounding the floating platform in its operative position and trapped thereon by means of an upright mast projecting from the floating platform and passing through the centre of the float.

8. A device according to claim 7 in which the sail of the float is rigid in nature, projecting in upright manner from the float.

9. A device for increasing the efficiency of an automatic cleaner in a swimming pool, said automatic cleaner comprising a suction head and a suction pipe connecting the suction head to a filter of the swimming pool, said automatic cleaner being adapted to sweep the submerged surface of said swimming pool in random movement, said device comprising:

an attachment member adapted to be attached to said suction pipe, said attachment member comprising a carrier ring adapted to embrace a pipe universal joint provided in said suction pipe, said carrier ring being located in a loose fitting manner on said pipe universal joint between annular collars provided on said universal joint, said annular collars preventing said carrier ring from slipping off said pipe universal joint;

a buoyant member adapted to float on the surface of said swimming pool, said buoyant member comprising a base member and an upstanding vane projecting from said base member, said vane being responsive in use to wind blowing over the surface of said swimming pool; and means for connecting said buoyant member to said attachment member, said means comprising a dependent rigid shaft extending between said buoyant member and said attachment member, said shaft permitting universal movement of said buoyant member relative to said attachment member;

said device in use of said automatic cleaner acting to interfere with said automatic cleaner to enhance the random nature of the movement of said automatic cleaner.

10. A device according to claim 9 in which said buoyant member comprises an inflatable member providing buoyancy when inflated.

11. An automatic cleaner for a swimming pool comprising:

a suction head;

a suction pipe connecting said suction head to a filter of said swimming pool;

an attachment member adapted to be attached to said suction pipe, said attachment member comprising a carrier ring adapted to embrace a pipe universal joint provided in said suction pipe, said carrier ring being located in a loose fitting manner on said pipe universal joint between annular collars provided on said universal joint, said annular collars preventing said carrier ring from slipping off said pipe universal joint;

a buoyant member adapted to float on the surface of said swimming pool, said buoyant member comprising a base member and an upstanding vane projecting from said base member, said vane being responsive in use to wind blowing over the surface of said swimming pool; and means for connecting said buoyant member to said attachment member, said means comprising a dependent rigid shaft extending between said buoyant member and said attachment member, said shaft permitting universal movement of said buoyant member relative to said attachment member;

said automatic cleaner being adapted to sweep the submerged surface of said swimming pool in random movement, said buoyant member in use of said automatic cleaner acting to interfere with said automatic cleaner to enhance the random nature of the movement of said automatic cleaner.

12. A cleaner according to claim 11 in which said buoyant member comprises an inflatable member providing buoyance when inflated.

* * * * *